US005863087A

United States Patent [19]

Swartz

[11] Patent Number: 5,863,087

[45] Date of Patent: Jan. 26, 1999

[54] LOCOMOTIVE CARRIER/PORTABLE STEAMING BAY APPARATUS

[76] Inventor: Walter Swartz, 6089 Lee Ann La., Naples, Fla. 34109

[21] Appl. No.: 831,681

[22] Filed: Apr. 10, 1997

[51] Int. Cl.[6] ..... B65G 7/12; E01B 23/00

[52] U.S. Cl. ..... 294/145; 104/48; 238/10 R; 294/1.1; 294/137; 294/167

[58] Field of Search ..... 294/1.1, 2, 15, 294/137, 141, 142, 144, 145, 159, 162, 163, 165, 167, 169; 104/45, 48, 307, DIG. 1; 238/10 R, 10 E, 10 F

[56] References Cited

U.S. PATENT DOCUMENTS

| | | | |
|---|---|---|---|
| 2,353,809 | 7/1944 | Carson | 294/165 |
| 2,998,196 | 8/1961 | Eenigenburg | 238/10 E X |
| 3,648,909 | 3/1972 | Wisecarver | 294/169 |
| 3,688,436 | 9/1972 | Wakimura | 238/10 E X |
| 4,626,015 | 12/1986 | Kruyt | 294/169 X |
| 5,454,513 | 10/1995 | Wilson | 238/10 E |

*Primary Examiner*—Johnny D. Cherry
*Attorney, Agent, or Firm*—Garvey, Smith, Nehrbass & Doody, L.L.C.

[57] ABSTRACT

A live steam locomotive carrier/portable steaming bay for a miniature train which would include a flat base portion of sufficient width and length to accommodate a standard miniature sized steam locomotive; a pair of parallel slots formed in the base portion from one end to the second end, for allowing the wheels of the locomotive to be placed into the slots so that the locomotive may be rolled along the length of the base portion; a peg member insertable into ports on both the first and second ends of the slot so that after the locomotive is in place the locomotive cannot inadvertently roll off of the first or second ends of the base portion; a pair of handle members extending upward from the base portion and each pair of handle members including a transverse portion for grasping by a person to carry the base portion in a substantial horizontal position with the steam locomotive thereupon; an indexing groove on at least one end of the base portion so that when the base portion is placed at the end of a track siding and the end portion is indexed onto a peg on the siding, the rail head of the siding lines up with the slots in the base portion; and adjusting screws on each corner of the base portion for raising or lowering the end portions of the base portion to accommodate the height of the rail head of the siding, so that once that is complete, the peg members are removed and the miniature steam locomotive is allowed to roll uninterrupted between the slotted base portion and the rail head of the siding so that the locomotive may then be placed into use.

13 Claims, 3 Drawing Sheets

LOCOMOTIVE CARRIER/PORTABLE STEAMING BAY APPARATUS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to miniature trains. More particularly, the present invention relates to an apparatus which can function as a miniature steam locomotive carrier or a portable steaming bay, so that when the bay is properly positioned adjacent a siding, the portable live steam engine may roll from the bay onto the siding tracks thus avoiding any hand manipulation of the steam engine in placement onto a siding.

2. General Background of the Invention

In the art of miniature trains, one of the more interesting miniature train assemblies includes the use of a live steam locomotive as part of the miniature train assembly. Such a locomotive is usually fed with coal or other fuel such as alcohol or butane, and is fired up so that the engine produces steam, as does a regular locomotive, and the live steam engine is then utilized to pull the miniature train around a particular track assembly. One of the problems that may be confronted in such a situation is that because of the delicate nature of a live steam locomotive, the person who is operating the locomotive must spend a great deal of time in getting the steam engine fired up properly, so that it can then be utilized on the track assembly. Usually the firing up of a miniature live steam locomotive is undertaken away from the track, so as to avoid the locomotive from interruption of any use of the track while it is being fired up. Although there are sidings which feed into the main track, one would not necessarily want to use the siding to fire up the locomotive since the sidings are utilized for the most part in allowing other train assemblies to move off of the main track while other assemblies move onto the track.

Therefore, the owners of miniature live steam locomotives have found various ways to move the locomotive from the point at which it has been fired up onto the siding so that it then may be utilized on the main track. As one can expect, this is a delicate matter in view of the fact that the locomotive, because it is a live steam locomotive, is often quite hot and unreceptive to being moved easily from one point to the next. Furthermore, manipulating a locomotive by one's hands may result in inadvertent dropping of the locomotive or damaging of the locomotive should one have to quickly release the locomotive due to heat or the like. Therefore, there is a need in the art for a system where a live steam locomotive may be fired up and then moved onto an area adjacent a track siding so that the locomotive may then be moved onto the siding and be put in use.

BRIEF SUMMARY OF THE INVENTION

The apparatus of the present invention solves the shortcomings in the art in a simple and straight forward manner.

What is provided is a live steam locomotive carrier/portable steaming bay for a miniature train which would include a flat base portion of sufficient width and length to accommodate any size/gauge locomotive; a pair of parallel slots formed in the base portion from one end to the second end, for allowing the wheels of the locomotive to be placed into the slots so that the locomotive may be rolled along the length of the base portion; a peg member insertable into ports on both the first and second ends of the base so that after the locomotive is in place the locomotive cannot inadvertently roll off of the first or second ends of the base portion; a pair of handle members extending upward from the base portion and each pair of handle members including a transverse portion for grasping by a person to carry the base portion in a substantial horizontal position with the steam locomotive thereupon; an indexing groove on at least one end of the base portion so that when the base portion is placed at the end of a track siding, and the end portion is indexed onto a peg on the siding, the rail head of the siding lines up with the slots in the base portion; and adjusting screws on each corner of the base portion for raising or lowering the end portions of the base portion to accommodate the height of the rail head of the siding, so that once that is complete, the peg members are removed and the miniature steam locomotive is allowed to roll uninterrupted from the slotted base portion onto the siding so that the locomotive may then be placed into use.

Therefore, it is the principal object of the present invention to provide a miniature locomotive carrier/portable steam bay apparatus which allows for transport of steam or other type of locomotives from one location to another without actually handling the locomotive, but allowing the locomotive to rest in slots on a base portion of the apparatus;

It is a further object of the present invention to provide a portable steaming bay for a steam locomotive which accommodates a standard sized steam locomotive thereupon and after the locomotive has been fired up, includes handle members for carrying the steam bay with the locomotive thereupon adjacent a siding for moving the locomotive from the steaming bay onto the siding for use;

It is a further object of the present invention to provide a portable steaming bay apparatus which would index with the tracks of a siding, thus aligning slots in the base portion of the apparatus with the rail head of the siding for allowing a locomotive on the base portion to roll easily from the base portion onto the siding for use;

It is a further object of the present invention to provide a portable steaming bay apparatus for steam locomotives which provides for vertical alignment of the carrier and the rail heads through adjusting or leveling screws located near the four corners of the carrier so that by turning the adjusting screws, the carrier can be made to match the height of the existing rail heads.

BRIEF DESCRIPTION OF THE SEVERAL VIEW OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

FIGS. 1–5 illustrate the preferred embodiment of the apparatus of the present invention by the numeral 10. For purposes of the application, the apparatus 10 will be designated as a portable steam bay apparatus 10. However, it is clear that the apparatus of the present invention is also utilized as a portable carrier for locomotive engines when transporting the engines from one location to the next, so that any designation as the invention as a portable steam bay apparatus may also imply a carrier apparatus for miniature locomotives.

Figure 1:
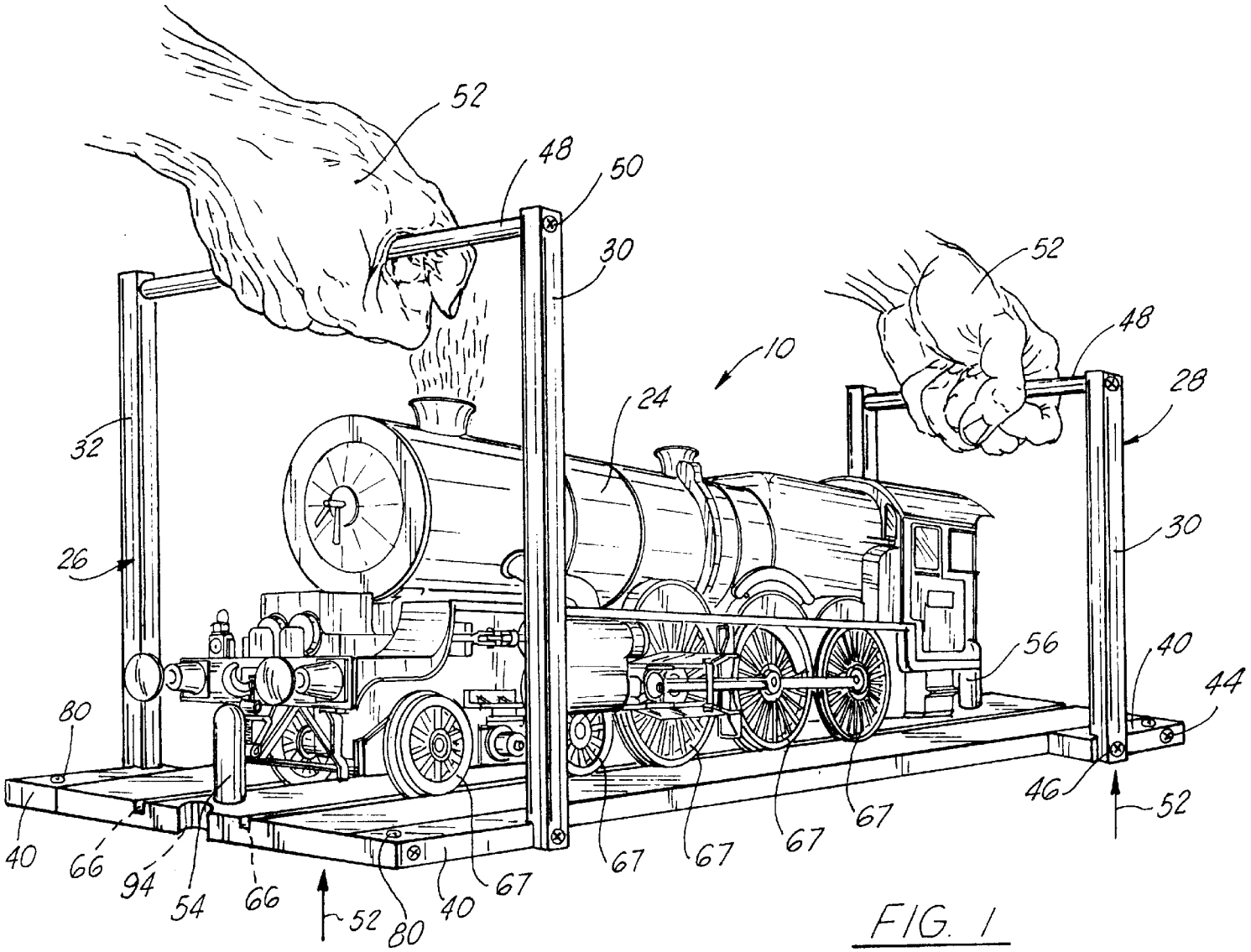
FIG. 1 illustrates an overall perspective view of the carrier/portable steaming bay apparatus, with a steam locomotive thereupon.
Figure 2:
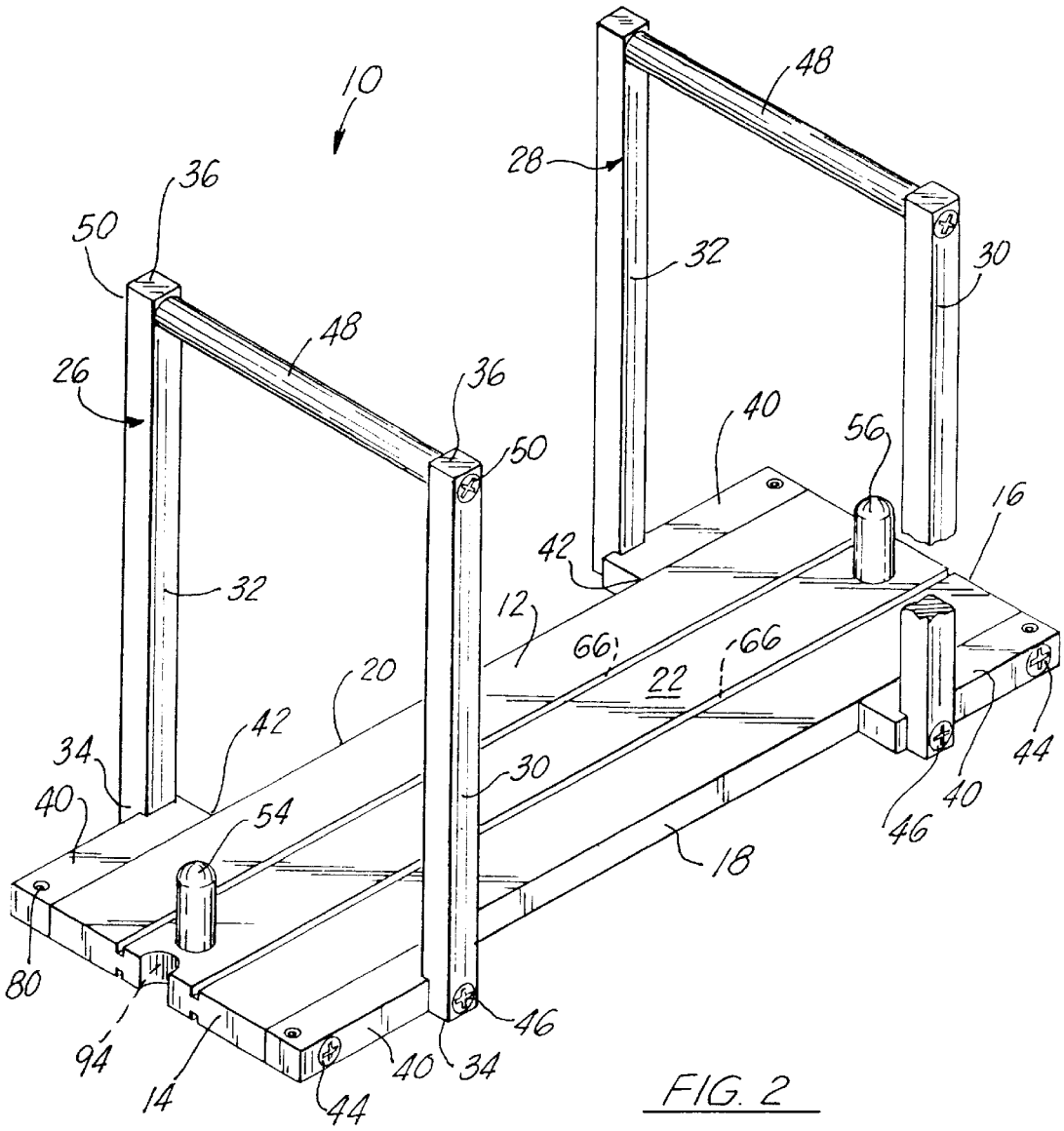
FIG. 2 illustrates an overall perspective view of the preferred embodiment of the carrier/portable steaming bay apparatus of the present invention.

Turning now in particular to FIGS. 1 and 2 in overall view, apparatus 10 would comprise an elongated base portion 12 having a first end 14, a second end 16, and a pair of side walls 18, 20, which would define a flat horizontal surface 22 upon which a locomotive 24 as seen in FIG. 1 would rest. For purposes of explanation, locomotive 24 as illustrated in FIG. 1 would comprise what is known as a miniature live steam locomotive which would be of the type that would be steam fired so that steam in the miniature locomotive actually drives the operation of the locomotive quite similar to a regular normal size train locomotive.

Returning now to the apparatus 10 as seen in FIGS. 1 and 2, apparatus 10 further includes a pair of upright handle members 26, 28, each of the upright handle members including a pair of parallel upright standards 30, 32, extending upward from a first lower end 34 to a second upper end 36. Each of the lower ends 34 of each of the handles 26, 28, would be engaged to an extender member 40, the extender member 40 secured to each of the edges 18, 20, the forward extender member 40 extending from the forward edge 14 of base member 12, to a point 42 along the edges 18, 20 of base member 12, and secured at each end of member 40 via a pair of screws 44, 46. Likewise, the rear end extenders 40 would extend from the rear edge 16 of base member 12 forward to a point 42, with each of the members 40 secured to the edges 18, 20 of base member 12 via a pair of screws 44, 46.

Figure 5:
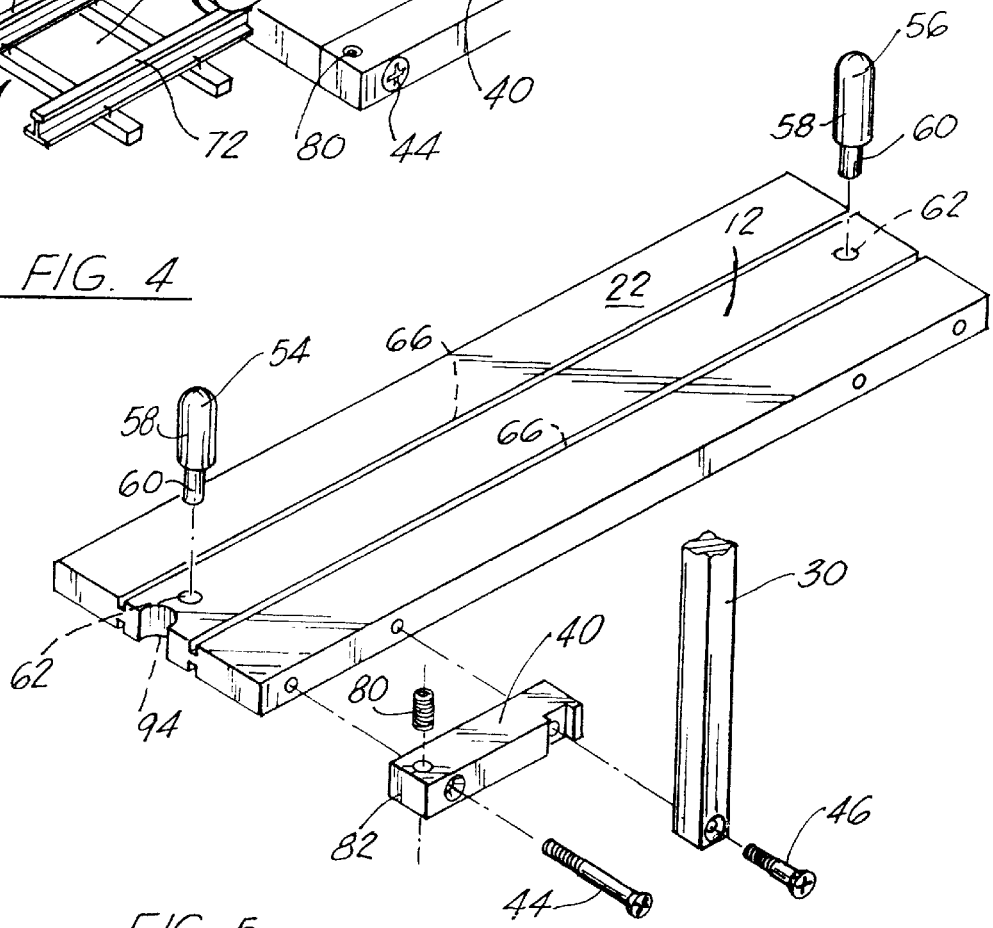
FIG. 5 illustrates an exploded view of the preferred embodiment of the apparatus of the present invention as the elements of the apparatus are secured onto one another.

As noted in both FIGS. 1, 2 and exploded view in FIG. 5, the screws 46 serve a dual function. Each of the upright standards 30, 32 is engaged onto the extenders 40 via screws 46 which are threadably engaged through extenders 40 into the sides 18, 20 of base member 12 in order to secure each of the upright standards 30, 32 in place. Further, the upper end 36 of each of the handles 30, 32, is engaged via a transverse bar 48 which is threadably engaged to the upper ends 36 of handle members 30, 32 via screws 50. Thus, as seen in FIG. 1, when the handle members are in place, a person may grasp them with their hands 52 onto each transverse bar 48 and lift the entire apparatus 10 from a surface in the direction of arrows 53 as illustrated in FIG. 1.

Turning now to particular features of the apparatus, again, reference is made to the Figures where there is illustrated, for example in FIGS. 1 and 2, a forward upright extending peg member 54 and a rear upward extending peg member 56. Each of the peg members 54, 56 as illustrated in FIG. 5 includes an upper body portion 58 and a lower plug portion 60, plug portion 60 insertable into a bore 62 formed in base 12 so that once the plug portions 60 are moved downward into bores 62, each of the pegs would be secure upon base member 12, as illustrated in FIGS. 1 and 2. The purpose is seen in FIG. 1. After locomotive 24 has been placed onto the base member 12, each of the peg members 54, 56, is then lowered in place and secured thereupon so that when the apparatus is being carrier as seen in FIG. 1, and is not necessarily maintained horizontal, the engine 24 will not have the ability to simply roll off of the face of the base 12, but will be stopped by each of the peg members 54, 56. Of course, when one would want to move the engine off the base, one would simply pull each peg 54, 56 off the base and roll the engine either rearward or forward as the case may be.

Figure 3:
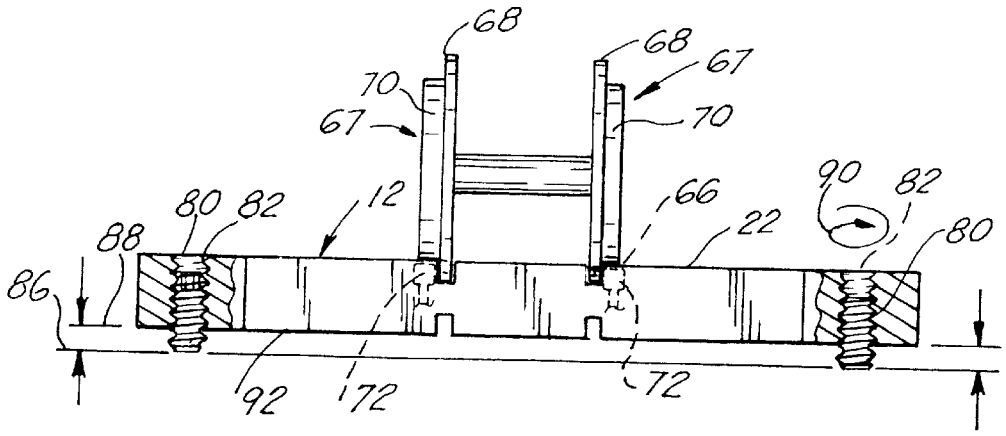
FIG. 3 illustrates a cross section end view of the base portion of the portable steaming bay apparatus of the present invention.

Turning now to another important feature in the apparatus 10, it should be noted that the surface 22 of base 12 further includes a pair of parallel grooves 66 formed in the entire length of base 12, with each of the grooves 66 as seen more clearly in cross section view in FIG. 3, accommodating the wheels 67 of engine 24, as it is placed upon base 12. By forming the grooves 66 in face 22 of base 12, it enables the primary rolling surface 70 of each of the engine wheels 67 to roll directly from the flat surface 22 of base 12 onto the rail head 72 of the siding bay 76. This is clearly seen in FIG. 3 where the rail heads 72 are illustrated in phantom view in FIG. 3, and as the wheels 67 of the locomotive 24 move from the flat surface 22 of base 12, the rolling surface 70 rolls directly onto the upper surface of each of the rail heads 72 so that the entire locomotive can be easily rolled from the carrier bay 10 onto the siding 76 at the exact level.

Figure 4:
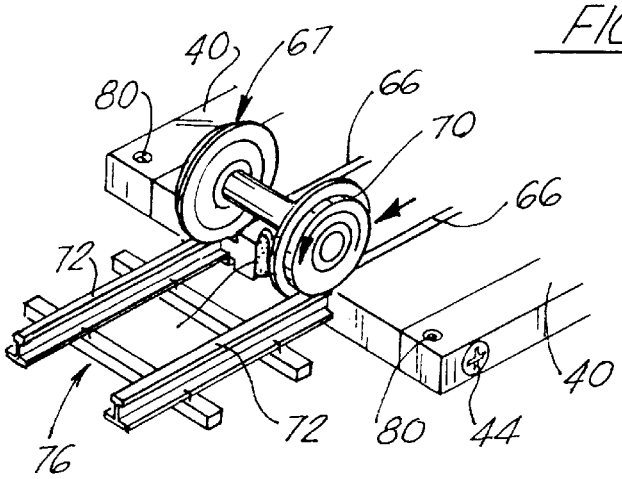
FIG. 4 illustrates a partial view of the base portion of the apparatus of the present invention aligned with the rail heads of a siding for accommodating the movement of the train onto the siding from the base portion.

In order to accomplish this, a proper alignment between the rail head 72 and the rolling surface 70 of wheels 67 of engine 24 is required. Reference again is made to FIG. 3 where there is illustrated vertical alignment screws 80, which in the preferred embodiment, may be allen screws which are threaded into a threaded port 82 in base 12, so that in order to vertically align, for example, the base 12 from surface 86 to the height 88 as seen in FIG. 3, one would rotate the alien screws in the direction of arrow 90, and the lower surface 92 of base 12 would be lifted the necessary vertical distance in order to properly align the rolling surface 70 of wheels 67 with the upper surface of rail head 72, as seen in FIG. 3. In the preferred embodiment as seen for example in FIG. 2, the ports 82 which accommodate allen screws 80 would be placed in the front portion of each of the extenders 40 which are attached to each corner of the base 12 so that any or all corners of base 12 may be raised or lowered in order to obtain proper alignment in moving the engine 24 from the base as seen in FIG. 1 to the rail head of siding 76 as seen in FIGS. 3 and 4.

An additional feature of the apparatus is illustrated quite clearly in FIG. 2 where there is a notched portion 94 on base 12. Notched portion 94 would accommodate a peg member 96 which may be positioned on the siding, so that as the bay is moved to align itself with the siding as seen in FIG. 4, the peg member 96 would engage into notch 94 which would assure that each of the slots 66 formed in the surface 22 of base 12 would be properly aligned with each of the rail heads 72 in a horizontal fashion so that then, one could rotate the alien screws 80 as necessary in order to properly align the rail head 72 vertically with the wheels 67 of the engine 24.

PARTS LIST

The following is a list of suitable parts and materials for the various elements of the preferred embodiment of the present invention.

| PARTS LIST | |
|---|---|
| apparatus | 10 |
| base portion | 12 |
| first end | 14 |
| second end | 16 |
| side walls | 18, 20 |
| horizontal surface | 22 |
| locomotive | 24 |
| upright handle members | 26, 28 |
| upright standards | 30, 32 |
| first lower end | 34 |
| second upper end | 36 |
| extender member | 40 |
| point | 42 |
| screws | 44, 46 |
| transverse bar | 48 |
| screws | 50 |
| hands | 52 |
| arrows | 53 |
| peg members | 54, 56 |
| upper body portion | 58 |
| lower plug portion | 60 |
| bores | 62 |
| grooves | 66 |
| wheels | 67 |
| primary rolling surface | 70 |
| rail head | 72 |
| siding bay | 76 |
| vertical alignment screws | 80 |
| threaded port | 82 |
| surface | 86 |
| height | 88 |
| arrow | 90 |
| lower surface | 92 |
| notch | 94 |
| peg member | 96 |

The foregoing embodiments are presented by way of example only; the scope of the present invention is to be limited only by the following claims.

I claim:

1. A carrier bay for a miniature train component, comprising:

a. a base portion including a surface for allowing a train component to be rolled thereupon;

b. a handle portion, extending from the base portion for carrying the carrier bay;

c. adjusting screws on the base portion for adjusting the height of the base portion relative to the height of a rail head of a siding as the train component is rolled between the siding and the base portion;

d. post members positionable before and after the train component on the base portion to avoid the train component from rolling off the base portion while being carried.

2. The carrier bay in claim 1, further comprising a pair of overhead handles for carrying the bay with the train component thereon.

3. The carrier bay in claim 1, wherein the base surface further comprises a pair of grooves which align with the rail head siding for allowing the train component to roll between the rail head and the carrier bay.

4. The carrier bay in claim 1, wherein the train component comprises a miniature train engine.

5. The carrier bay in claim 1, wherein the handle portion is removably attached to the base portion.

6. The carrier bay in claim 1, wherein the adjusting screws further comprise a plurality of allen screws threaded into four corners of the base portion, so that sufficient threading of the screws will raise one or more corners of the base portion to align with the rail head.

7. A carrier bay for a miniature train engine, comprising:

a. a base portion including a surface for allowing a train component to be rolled from a siding onto the base portion;

b. handle portions, extending upward from the base portion for carrying the carrier bay;

c. adjusting screws on the base portion for adjusting the height of the base portion relative to a height of a rail head of the siding when the train engine is rolled between the siding and the base portion;

d. post members positionable before and after the train engine on the base portion to avoid the train engine from rolling off the base portion; and e. a pair of grooves formed in the base portion surface for accommodating a portion of the wheels of the train engine as it is rolled between the siding and the base portion.

8. The carrier bay in claim 7, wherein the handle portion extend upward from the sides of the base portion for carrying the bay with the train component thereon.

9. The carrier bay in claim 7, wherein the handle portions are removably attached to the base portion.

10. The carrier bay in claim 7, wherein the adjusting screws further comprise a plurality of allen screws threaded into four corners of the base portion, so that sufficient threading of the screws will raise one or more corners of the base component to align with the siding.

11. A carrier bay for a miniature train engine, comprising:

a. a base portion including a grooved surface for allowing a train component to be rolled between a rail head of a siding and the grooved surface in the base portion;

b. handle portions, extending upward from the base portion for carrying the carrier bay;

c. a plurality of allen-type adjusting screws positioned at four corners of the base portion for adjusting the height of the base portion relative to the height of the rail head upon which the train engine is rolled, so that sufficient threading of the screws will raise one or more corners of the base portion to align with the rail head;

d. post members positionable before and after the train engine on the base portion to avoid the train engine from rolling off the base portion; and e. a pair of grooves formed in the base portion surface for accommodating the wheels of the train engine as it is rolled between the siding and the base portion.

12. The carrier bay in claim 11, wherein the handle portions extend upward from the sides of the base portion for carrying the bay with the train component thereon.

13. The carrier bay in claim 11, wherein the handles are removably attached to the bay portion.

* * * * *